US006860101B2

(12) United States Patent
Kako et al.

(10) Patent No.: US 6,860,101 B2
(45) Date of Patent: Mar. 1, 2005

(54) EXHAUST GAS PURIFICATION SYSTEM FOR INTERNAL COMBUSTION ENGINE

(75) Inventors: Junichi Kako, Susono (JP); Toshinari Nagai, Mishima (JP); Naoto Katoh, Susono (JP); Akihiro Katayama, Toyota (JP); Kentaro Matsumoto, Numazu (JP); Shinji Kojima, Aichi (JP); Naoki Baba, Aichi (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/266,582

(22) Filed: Oct. 9, 2002

(65) Prior Publication Data

US 2003/0070419 A1 Apr. 17, 2003

(30) Foreign Application Priority Data

Oct. 15, 2001 (JP) ..... 2001-317192
Dec. 27, 2001 (JP) ..... 2001-397875

(51) Int. Cl.[7] ..... F01N 3/00

(52) U.S. Cl. ..... 60/285; 60/274; 60/297; 60/301

(58) Field of Search ..... 60/285, 286, 274, 60/301, 297, 295

(56) References Cited

U.S. PATENT DOCUMENTS 5,412,945 A * 5/1995 Katoh et al. ..... 60/285
5,970,707 A * 10/1999 Sawada et al. ..... 60/277
5,974,793 A * 11/1999 Kinugasa et al. ..... 60/285
6,195,987 B1 * 3/2001 Miyashita ..... 60/285
6,502,389 B2 * 1/2003 Katayama et al. ..... 60/285

FOREIGN PATENT DOCUMENTS

JP A 7-139340 5/1995
JP A 8-296472 11/1996
JP A 2000-80921 3/2000
JP A 2000-320372 11/2000

* cited by examiner

*Primary Examiner*—Binh Q. Tran
(74) *Attorney, Agent, or Firm*—Oliff & Berridge, PLC

(57) ABSTRACT

An exhaust gas purification system comprises a NOx catalyst for absorbing the NOx in the exhaust gas when the air-fuel ratio of the influent exhaust gas is lean and purifying by reducing the absorbed NOx with a reducing agent in the exhaust gas when the air-fuel ratio of the exhaust gas turns rich, a first unit for calculating the amount of NOx absorbed per unit time in each area of the NOx catalyst when the air-fuel ratio of the exhaust gas flowing into the NOx catalyst is lean, and a second unit for calculating the total amount of NOx absorbed into the NOx catalyst by totaling the amounts of NOx calculated by the first calculation unit for the areas of the NOx catalyst.

11 Claims, 6 Drawing Sheets

$$Cnox(k) = A \times Cnox \times u - \sum_{n=1}^{k-1} Vnox(n)$$

$$Vnox(k) = (A \times Cnox \times u - \sum_{n=1}^{k-1} Vnox(n)) \times ks0 \times ks(k) \times (Anoxmax(k) - Anox(k)) \quad \cdots (1)$$

$$Anox(k) = \int_0^t Vnox(k)\, dt \quad \cdots (2)$$

$$Atotal = \sum_{k=1}^{n} Anox(k) \quad \cdots (3)$$

$$Vnox(k) = -(A \times Chc \times u - \alpha \times \sum_{n=1}^{k} Vnox(n)) \times kr0 \times kr(k) \times Anox(k) \quad \cdots (4)$$

EXHAUST GAS PURIFICATION SYSTEM FOR INTERNAL COMBUSTION ENGINE

FIELD OF THE INVENTION

The present invention relates to an exhaust gas purification system for the internal combustion engine.

DESCRIPTION OF THE RELATED ART

A NOx catalyst is known which purifies the nitrogen oxides (NOx) contained in the exhaust gas emitted from an internal combustion engine. The NOx catalyst of a type in which the NOx in the exhaust gas flowing into the catalyst is absorbed when the air-fuel ratio of the exhaust gas is lean, and once the air-fuel ratio of the influent exhaust gas turns rich, the NOx that has been absorbed is discharged, and the NOx thus discharged is purified by being reduced with such a reducing agent as HC, CO or $H_2$ contained in the exhaust gas, is well known.

The NOx catalyst of this type is used mainly with an internal combustion engine of such a type that the combustion in the engine is carried out at a lean air-fuel ratio in most engine operating areas. In this case, as long as the exhaust gas of a lean air-fuel ratio is emitted from the internal combustion engine, the NOx contained in the exhaust gas continues to be absorbed into the NOx catalyst. In view of the fact that the exhaust gas of a lean air-fuel ratio is emitted from the internal combustion engine in almost all engine operating areas, the total amount of NOx absorbed into the NOx catalyst (hereinafter referred to as the total absorbed NOx amount) soon exceeds the maximum NOx amount that can be absorbed by the catalyst (hereinafter referred to as the maximum absorbable NOx amount). Then, NOx can no longer be absorbed into the NOx catalyst and flows out downstream from the NOx catalyst, thereby deteriorating the emission.

In the case where the NOx catalyst of the type described is used in the internal combustion engine of the type described above, therefore, it is necessary to supply the exhaust gas of a rich air-fuel ratio to the NOx catalyst, to purify it, by reducing NOx before the total absorbed NOx amount exceeds the maximum absorbable NOx amount.

For deciding whether the exhaust gas of a rich air-fuel ratio is to be supplied to the NOx catalyst or not, it is necessary to detect the total absorbed NOx amount as accurately as possible. In a simple means for calculating the total absorbed NOx amount, the concentration of the NOx that has flowed into the NOx catalyst is multiplied by the amount of NOx that can be absorbed into the NOx catalyst per unit NOx concentration of the NOx catalyst per unit time (hereinafter referred to as the NOx absorption rate constant), and the amounts of NOx that have been absorbed into the NOx catalyst per unit time (hereinafter referred to as the unit absorbable NOx amount) are accumulated.

The NOx absorption rate changes with the maximum absorbable NOx amount of the NOx catalyst and the total absorbed NOx amount which constantly undergoes a change. With the means mentioned above, therefore, the total absorbed NOx amount cannot always be detected accurately. In view of this, according to Japanese Unexamined Patent Publication No. 8-296472, the NOx absorption rate constant corresponding to the maximum absorbable NOx amount of the NOx catalyst and the total absorbed NOx amount at a particular time point is calculated and used to calculate the total absorbed NOx amount.

The maximum absorbable NOx amount of the NOx catalyst and the constantly-changing total absorbed NOx amount are not the only factors affecting the NOx absorption rate constant of the NOx catalyst. Specifically, if the total absorbed NOx amount is to be detected more accurately, the method of calculating the total absorbed NOx amount described in the publication cited above still has room for improvement.

Also, in an internal combustion engine with an exhaust gas purification catalyst such as a three-way catalyst arranged upstream of the NOx catalyst, the total amount of NOx absorbed into the NOx catalyst must be calculated by taking the effect of the exhaust gas purification catalyst into consideration.

Accordingly, it is an object of the present invention to calculate more accurately the total amount of NOx absorbed into the NOx catalyst.

SUMMARY OF THE INVENTION

According to the first invention, there is provided an exhaust gas purification system comprising a NOx catalyst for absorbing the NOx in the influent exhaust gas when the air-fuel ratio of the influent exhaust gas is lean and purifying it by reducing the absorbed NOx with a reducing agent in the exhaust gas when the air-fuel ratio of the influent exhaust gas turns rich, calculation means for calculating the amount of NOx absorbed per unit time in each area of the NOx catalyst when the air-fuel ratio of the exhaust gas flowing into the NOx catalyst is lean, and means for calculating the total amount of NOx absorbed into the NOx catalyst by totalizing the amount of NOx in all the areas of the NOx catalyst.

According to the second invention, the first invention further comprises means for supplying the exhaust gas of a rich air-fuel ratio to the NOx catalyst when the NOx amount reaches a tolerable critical value.

According to the third invention, there is provided an exhaust gas purification system comprising a NOx catalyst arranged in the exhaust path, an exhaust gas purification catalyst arranged in the exhaust path upstream of the NOx catalyst, calculation means for calculating the value associated with the amount of at least one component flowing out from the exhaust gas purification catalyst into the NOx catalyst, and rich spike execution means for executing the rich spike operation based on the value associated with the component amount calculated by the calculation means.

According to the fourth invention, in the third invention, the component is NOx and the value associated with the amount of the component calculated by the calculation means is an accumulated value of the amount of NOx flowing into the NOx catalyst.

According to the fifth invention, in the third invention, the component includes NOx absorbed into the NOx catalyst when the rich spike operation is not executed and a reducing component for reducing the NOx absorbed into the NOx catalyst when the rich spike operation is executed, and the value associated with the amount of the component calculated by the calculation means is a value obtained by accumulating the amount of NOx flowing into the NOx catalyst when the rich spike operation is not executed and by subtracting a value associated with the amount of the reducing component flowing into the NOx catalyst when the rich spike operation is executed.

According to the sixth invention, in the fourth invention, the amount of the reducing agent flowing into the NOx catalyst is controlled based on the amount of the reducing component flowing into the NOx catalyst when the rich spike operation is executed.

According to the seventh invention, in the third invention, the component is NOx, and the NOx catalyst absorbs the NOx in the exhaust gas when the air-fuel ratio of the exhaust gas flowing into the NOx catalyst is lean and purifies the absorbed NOx by being reduced with the reducing component in the exhaust gas when the air-fuel ratio of the influent exhaust gas turns rich.

According to the eighth invention, there is provided an exhaust gas purification system comprising a NOx catalyst arranged in the exhaust path, an exhaust gas purification catalyst arranged in the exhaust path upstream of the NOx catalyst, first calculation means for calculating the amount of the component flowing out from the exhaust gas purification catalyst and absorbed into each area of the NOx catalyst per unit time, second calculation means for calculating the total amount of the component absorbed into the areas of the NOx catalyst calculated by the first calculation means thereby to obtain the total amount of the component absorbed into the NOx catalyst, and rich spike execution means for executing the rich spike operation based on the amount of the component calculated by the second calculation means.

According to the ninth invention, in the eighth invention, the component is NOx, and the NOx catalyst absorbs the NOx in the exhaust gas when the air-fuel ratio of the influent exhaust gas is lean while the NOx catalyst purifies the absorbed NOx by being reduced with the reducing agent in the exhaust gas when the air-fuel ratio of the influent exhaust gas turns rich.

According to the tenth invention, in the eighth invention, the component is NOx, and the total component amount calculated by the second calculation means is the accumulated value of the amount of NOx absorbed into the NOx catalyst.

According to the eleventh invention, in the eighth invention, the component includes NOx absorbed into the NOx catalyst when the rich spike operation is not executed and the reducing component for reducing the NOx absorbed into the NOx catalyst when the rich spike operation is executed, and the total component amount calculated by the second calculation means is a value obtained by accumulating the amount of NOx absorbed into the NOx catalyst when the rich spike operation is not executed and by subtracting a value associated with the amount of the reducing component flowing into the NOx catalyst when the rich spike operation is executed.

According to the twelfth invention, in the eleventh invention, the amount of the reducing agent flowing into the NOx catalyst is controlled based on the amount of the reducing component flowing into the NOx catalyst when the rich spike operation is executed.

DESCRIPTION OF THE PREFERRED EMBODIMENTS

Figure 1:
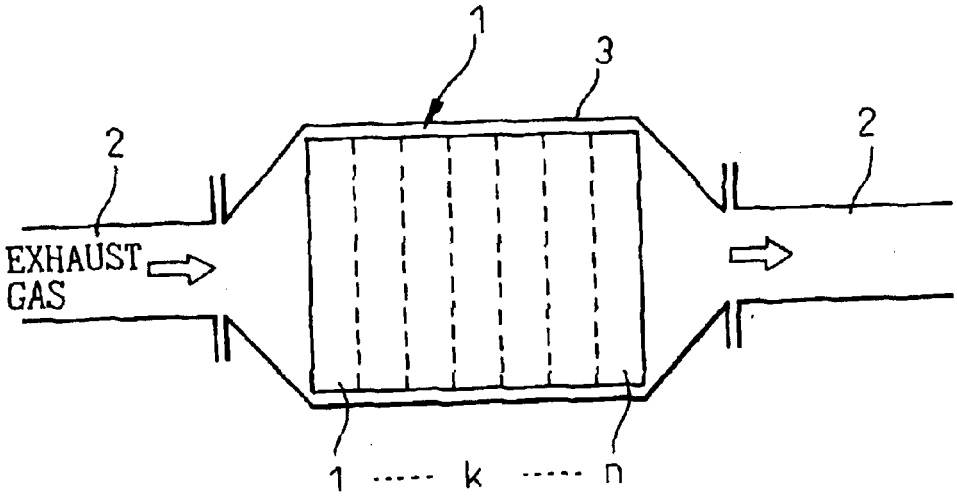
FIG. 1 is a diagram showing a NOx catalyst.

This invention will be explained below. The exhaust gas purification system according to the first embodiment of the invention has a NOx catalyst 1 as shown in FIG. 1. If the ratio of the amount of air to the amount of the fuel (hydrocarbon) supplied into the engine intake path, the combustion chamber and the exhaust path upstream of the NOx catalyst 1 is defined as an air-fuel ratio of the exhaust gas, the NOx catalyst 1 absorbs NOx (nitrogen oxides) in the exhaust gas in the case where the air-fuel ratio of the influent exhaust gas is lean, and discharges the absorbed NOx in the case where the air-fuel ratio of the influent exhaust gas turns rich. The NOx thus discharged can be purified by being reduced with the reducing agent such as HC, CO or $H_2$ contained in the exhaust gas.

The NOx catalyst 1 includes a NOx absorbent and a catalyst metal. The NOx absorbent is composed of alumina as a carrier, for example, for carrying at least a selected one of an alkali metal such as potassium K, sodium Na, lithium Li or cesium Cs, an alkaline earth such as barium Ba or calcium Ca, and a rare earth such as lanthanum La or yttrium Y and a precious metal such as platinum Pt.

Figure 2:
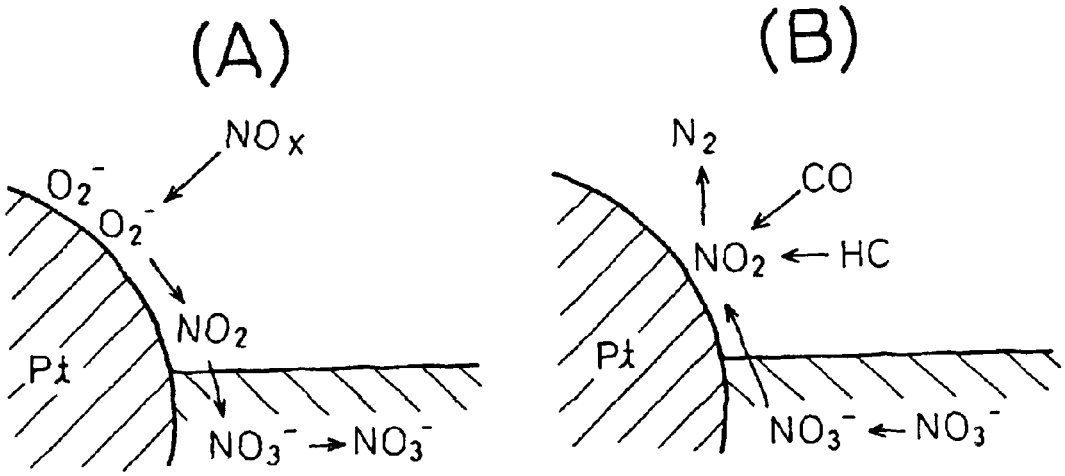
FIG. 2 is a diagram showing a NOx absorption/discharge mechanism of the NOx catalyst.

The detailed mechanism of the absorb-discharge operation of NOx absorbent has not been entirely clarified. Nevertheless, the absorb-discharge operation is considered to be performed with the mechanism as shown in FIG. 2. This mechanism will be explained with reference to a case in which platinum Pt and barium Ba are carried on the carrier. A similar mechanism applies also to other precious metals, alkali metals, alkaline earth and rare earth.

In the internal combustion engine having the NOx catalyst according to the first embodiment, the combustion is conducted with a lean air-fuel ratio in most of the operating conditions often used. In the case where the combustion goes on with a lean air-fuel ratio, the oxygen concentration of the exhaust gas is so high that as shown in FIG. 2A, the oxygen $O_2$ attaches to the surface of the platinum Pt in the form of $O_2^-$ or $O_2^-$. On the other hand, NO contained in the influent exhaust gas reacts with $O_2^-$ or $O^{2-}$ on the surface of platinum Pt to form $NO_2$ ($2NO+O_2 \rightarrow 2NO_2$). Then, part of the $NO_2$ thus generated is oxidized on the platinum Pt while at the same time being absorbed into the absorbent and bonded with barium oxide BaO. At the same time, as shown in FIG. 2A, $NO_2$ is diffused in the absorbent in the form of nitrate ions $NO_3^-$. In this way, NOx is absorbed into the NOx absorbent. As long as the oxygen concentration of the influent exhaust gas remains high, $NO_2$ is generated on the surface of platinum Pt, so that as long as the NOx absorption capacity of the absorbent is not saturated, $NO_2$ is absorbed into the absorbent and nitrate ions $NO_3^-$ are generated.

Once the air-fuel ratio of the influent exhaust gas turns rich, the oxygen concentration of the inflowing exhaust gas decreases, with the result that the amount of $NO_2$ generated on the surface of platinum Pt decreases. With the decrease in the amount of $NO_2$ generated, the reaction occurs in reverse direction ($NO_3 \rightarrow NO_2$), and the nitrate ions $NO_3^-$ in the absorbent are released in the form of $NO_2$ from the absorbent. After being released from the NOx absorbent, NOx is reduced by reacting with a large amount of the reducing agents such as C, CO and $H_2$ remaining unburned in the influent exhaust gas, as shown in FIG. 2B. Each time after $NO_2$ disappears from the surface of platinum Pt in this way, $NO_2$ is released successively from the absorbent. Once the air-fuel ratio of the influent exhaust gas turns rich, therefore, NOx is released from the NOx absorbent and reduced within a short time and, therefore, it is not discharged into the atmosphere.

The NOx catalyst 1 according to the first embodiment is arranged in a casing 3 making up a part of the exhaust path 2.

The NOx catalyst 1 has a critical value up to which NOx can be absorbed to a maximum (hereinafter referred to as the maximum absorbable NOx amount). In the case where the NOx catalyst 1 is used in the exhaust path 2 of the internal combustion engine as described above, the exhaust gas of a lean air-fuel ratio flows into the NOx catalyst in most of the engine operating zones. Thus, the total amount of NOx absorbed into the NOx catalyst 1 (hereinafter referred to as the total NOx amount) reaches the maximum absorbable NOx amount. In such a case, a continued flow of the exhaust gas of a lean air-fuel ratio into the NOx catalyst 1 which can no longer absorb NOx from the exhaust gas would cause NOx to flow out downstream through the NOx catalyst 1, thereby deteriorating the gas emission.

According to the first embodiment of the invention, the total NOx amount which undergoes a constant change is calculated and, before the total NOx amount exceeds the maximum absorbable NOx amount, the exhaust gas of a rich air-fuel ratio (hereinafter referred to as the rich gas) is supplied to the NOx catalyst 1 so that the NOx absorbed into the NOx catalyst 1 is released from the NOx catalyst 1. In the process, the nearer the calculated total NOx amount to the true total NOx amount, the higher the accuracy with which the outflow of NOx downstream of the NOx catalyst 1 can be suppressed. Specifically, the calculation of the total NOx amount as near to the true value as possible is important for maintaining the gas emission in a satisfactory state. According to the first embodiment, the total NOx amount is calculated by the following method.

The greater the current amount of NOx absorbable into the NOx catalyst 1 per unit (hereinafter referred to as the NOx absorption rate constant), the greater the amount of NOx absorbed into the NOx catalyst 1 per unit time (hereinafter referred to as the unit absorbed NOx amount). In other words, the accurate calculation of the unit absorbed NOx amount requires the accurate determination of the NOx absorption rate constant at a particular time point.

Figures 3, 4, 5:
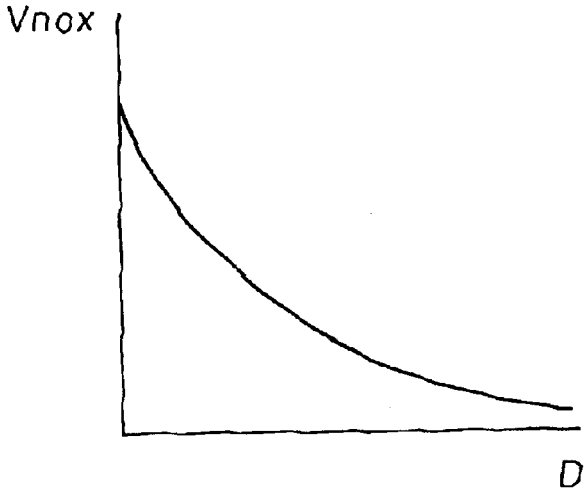
FIG. 3 is a diagram showing the relation between the distance D from the precious metal of the NOx catalyst to the NOx absorbent and the NOx absorption rate Vnox.
FIG. 4 is a diagram showing an equation for calculating the NOx concentration of the exhaust gas flowing into the catalyst area.
FIG. 5 is a diagram showing equations for calculating the total absorbed NOx amount.

The NOx catalyst 1 contains a precious metal and a NOx absorbent. The NOx absorption rate constant varies with the distance between the precious metal and the NOx absorbent. As shown in FIG. 3, the longer the distance D from the precious metal to the NOx absorbent, the smaller the NOx absorption rate constant Vnox.

The NOx absorbent is mounted in the layer coated on the wall surface of the catalyst carrier. The NOx absorption rate constant also varies with the distance between the surface of the coat layer and the NOx absorbent. In other words, the larger the distance between the surface of the coat layer and the NOx absorbent, the smaller the NOx absorption rate constant.

Further, NOx reaches the NOx absorbent by diffusion through the coat layer, and the NOx absorption rate constant varies with the NOx diffusion rate constant in the coat layer. In other words, the larger the NOx diffusion rate constant in the coat layer, the larger the NOx absorption rate constant.

The effect that the three parameters described above, i.e. the distance from the precious metal to the NOx absorbent, the distance from the surface of the coat layer to the NOx absorbent and the NOx diffusion rate constant in the coat layer, have on the NOx absorption rate constant remains unchanged with the operating conditions of the NOx catalyst but is determined initially. In the case where the NOx absorption rate constant is determined experimentally beforehand for each of a plurality of areas (hereinafter referred to as catalyst areas) into which the whole internal area of the NOx catalyst 1 is divided, therefore, the NOx absorption rate constant thus determined reflects the effect of the three parameters described above. The three parameters described above may somewhat change with the degree of degeneration of the NOx catalyst. Therefore, it is desirable to use the NOx absorption rate constant determined while the engine is running.

The NOx absorption rate constant for each catalyst area determined experimentally beforehand is the maximum NOx absorption rate constant that can be achieved initially for each catalyst area. In the description that follows, therefore, the NOx absorption rate constant determined experimentally for each area beforehand is referred to as the initial NOx absorption rate constant.

Further, the NOx absorption rate constant changes with the amount of NOx already absorbed into the NOx catalyst 1 (total absorbed NOx amount). In other words, the greater the total absorbed NOx amount, the smaller the NOx absorption rate constant. The total absorbed NOx amount constantly changes while the NOx catalyst 1 is in operation. The calculation of the total absorbed NOx amount during the operation of the NOx catalyst 1, therefore, requires consideration of the total absorbed NOx amount.

The NOx absorption rate constant also changes with the NOx concentration of the exhaust gas flowing into the NOx catalyst 1. In other words, the higher the NOx concentration of the exhaust gas, the larger the NOx absorption rate constant. The NOx concentration of the exhaust gas constantly changes while the NOx catalyst 1 is in operation. In calculating the total absorbed NOx amount during the operation of the NOx catalyst 1, therefore, it is necessary also to take the NOx concentration of the exhaust gas into account.

In addition, the NOx concentration of the exhaust gas that has flowed into the NOx catalyst 1 decreases as the exhaust gas flows downstream within the NOx catalyst. This is because the NOx contained in the exhaust gas is absorbed from the upstream side thereof and decreases in amount progressively as it flows downstream. In calculating the total absorbed NOx amount taking the NOx concentration of the exhaust gas into account during the operation of the NOx catalyst 1, therefore, it is also necessary to take into consideration the fact that the NOx concentration of the exhaust gas decreases progressively downstream in the NOx catalyst 1.

Taking the aforementioned facts into consideration, according to the first embodiment, as shown in FIG. 1, the NOx catalyst 1 extending from the exhaust gas inlet to the exhaust gas outlet is divided equidistantly into n catalyst areas. The NOx absorption rate constant for each catalyst area, the total absorbed NOx amount for each catalyst area and the total absorbed NOx amount for the whole NOx catalyst 1 are calculated according to the equations shown in FIG. 5. The NOx catalyst 1 extending from the exhaust gas inlet to the exhaust gas outlet, which is divided equidistantly into a plurality of catalyst areas according to the first embodiment, can be divided into a plurality of catalyst areas in various alternative manners. Basically, however, the NOx catalyst 1 is divided into a plurality of areas by the NOx absorption rate constants.

In the first embodiment, the NOx absorption rate constant Vnox(k) for the kth catalyst area of the NOx catalyst 1 as counted from the most upstream side one as the first catalyst area is calculated first according to equation (1) shown in FIG. 5. In this equation, Cnox designates the NOx concentration of the exhaust gas flowing into the first catalyst area, and Vnox(k−1) the NOx absorption rate constant for the (k−1)th catalyst area. Also, character A designates the sectional area of the flow path at the NOx catalyst inlet, and character u the gas flow rate at the NOx catalyst inlet. Thus, the value Cnox(k) calculated by the equation shown in FIG. 4 is the NOx concentration of the exhaust gas flowing into the kth catalyst area.

Further, ksO designates the initial NOx absorption rate constant of the NOx catalyst 1 determined experimentally beforehand, and ks(k) a conversion coefficient for converting the initial NOx absorption rate constant ksO into the initial NOx absorption rate constant for the kth catalyst area. Thus, ksO×ks(k) represents the initial NOx absorption rate constant for the kth catalyst area.

Also, Anoxmax(k) designates the maximum absorbable NOx amount for the kth catalyst area, and Anox(k) the total absorbed NOx amount for the kth catalyst area. In other words, Anoxmax(k)−Anox(k) is the NOx amount that can still be absorbed by the kth catalyst area. The larger this NOx amount, the larger the NOx absorption rate constant for the kth catalyst area.

Then, the total absorbed NOx amount Anox(k) for the kth catalyst area is calculated according to equation (2) shown in FIG. 5. Specifically, the NOx absorption rate constant Vnox(k) for each catalyst area calculated according to equation (1) shown in FIG. 5 is integrated with time thereby to calculate the total absorbed NOx amount Anox(k) for the kth catalyst area.

As the next step, the total absorbed NOx amount Atotal for the whole NOx catalyst 1 is calculated according to equation (3) in FIG. 5. Specifically, the total absorbed NOx amount Atotal for the whole NOx catalyst 1 is calculated by accumulating the total absorbed NOx amount Anox(1) for the first catalyst area to the total absorbed NOx amount Anox(n) for the nth catalyst area calculated according to equation (2) in FIG. 5.

In the case where a rich gas is supplied to the NOx catalyst 1 and NOx is discharged from the NOx catalyst 1, the total absorbed NOx amount is decreased. In that case, a rich gas can be supplied to the NOx catalyst 1 to reduce the total absorbed NOx amount to zero, only at the sacrifice of a deteriorated fuel cost for the reason described below. Specifically, even in the case where a rich gas is supplied to the NOx catalyst 1, all the NOx is not immediately discharged from the NOx catalyst 1, but actually, a considerable amount of NOx remains in some of the areas of the NOx catalyst 1. In spite of the very small amount of the remaining NOx, a rich gas must still be supplied to discharge the residual NOx from each catalyst area. In this case, part of HC in the exhaust gas would wastefully remain unused for discharging and reducing NOx.

In view of this, a rich gas is supplied to the NOx catalyst 1 to such an extent that the HC supplied to the NOx catalyst 1 is not wasted, the amount of NOx remaining in the NOx catalyst 1 (i.e. the total absorbed NOx amount) with the rich gas supply stopped is accurately detected, and the next timing of supplying a rich gas is determined using the total absorbed NOx amount. In this way, the deterioration of the gas emission can be suppressed in general while at the same time preventing the deterioration of the fuel economy.

According to the first embodiment, therefore, as long as a rich gas is supplied to the NOx catalyst 1, the NOx absorption rate constant (actually, the NOx discharge rate constant) for the kth catalyst area is calculated according to equation (4) shown in FIG. 5 instead of equation (1) shown in FIG. 5.

The NOx discharge rate constant for each catalyst area is varied depending on the amount of NOx absorbed in the NOx catalyst 1 at a particular time point. Thus, the greater the total absorbed NOx amount, the greater the NOx discharge rate constant. As described above, the total absorbed NOx amount undergoes a constant change while a rich gas is supplied to the NOx catalyst 1 (i.e. during the process of reducing the NOx catalyst 1). In calculating the total absorbed NOx amount during the reduction processing of the NOx catalyst 1, therefore, the total absorbed NOx amount is required to be taken into consideration.

Further, the NOx discharge rate constant is varied with the concentration of the reducing agent such as HC, CO or $H_2$ contained in the exhaust gas flowing into the NOx catalyst 1, so that the higher the concentration of the reducing agent contained in the exhaust gas, the larger the NOx discharge rate constant. The concentration of the reducing agent contained in the exhaust gas constantly changes during the reduction processing of the NOx catalyst 1. The calculation of the total absorbed NOx amount during the reduction processing of the NOx catalyst 1, therefore, requires consideration also of the concentration of the reducing agent contained in the exhaust gas.

Furthermore, the concentration of the reducing agent contained in the exhaust gas flowing into the NOx catalyst 1 decreases according as the exhaust gas proceeds downstream in the NOx catalyst 1. This is because the reducing agent contained in the exhaust gas is consumed progressively from the upstream side and decreases in amount as it proceeds downstream in the NOx catalyst 1. In the case where the total absorbed NOx amount is calculated during the reduction processing of the NOx catalyst 1 while taking the concentration of the reducing agent contained in the exhaust gas into consideration, therefore, it is necessary to take into consideration the fact that the concentration of the reducing agent contained in the exhaust gas is decreased progressively downstream in the NOx catalyst 1.

The facts described above are reflected in equation (4) shown in FIG. 5. In equation (4) of FIG. 5, Chc is the concentration of the reducing agent contained in the exhaust gas flowing into the first catalyst area, and character $\alpha$ a conversion coefficient for converting the NOx discharge rate constant for the (k−1)th catalyst area into the concentration of the reducing agent contained in the exhaust gas flowing into the kth catalyst area.

Characters kr0 designate an initial NOx discharge rate constant of the NOx catalyst 1 determined experimentally before the use of the NOx catalyst 1, and characters kr(k) a conversion coefficient for converting this initial NOx discharge rate constant to the initial NOx discharge rate constant for the kth catalyst area. Thus, kr0×kr(k) represents the initial NOx discharge rate constant for the kth catalyst area.

Character Anox(k) designates the total absorbed NOx amount for the kth catalyst area. The larger the value Anox(k), the larger the NOx discharge rate constant for the kth catalyst area.

Figure 6:
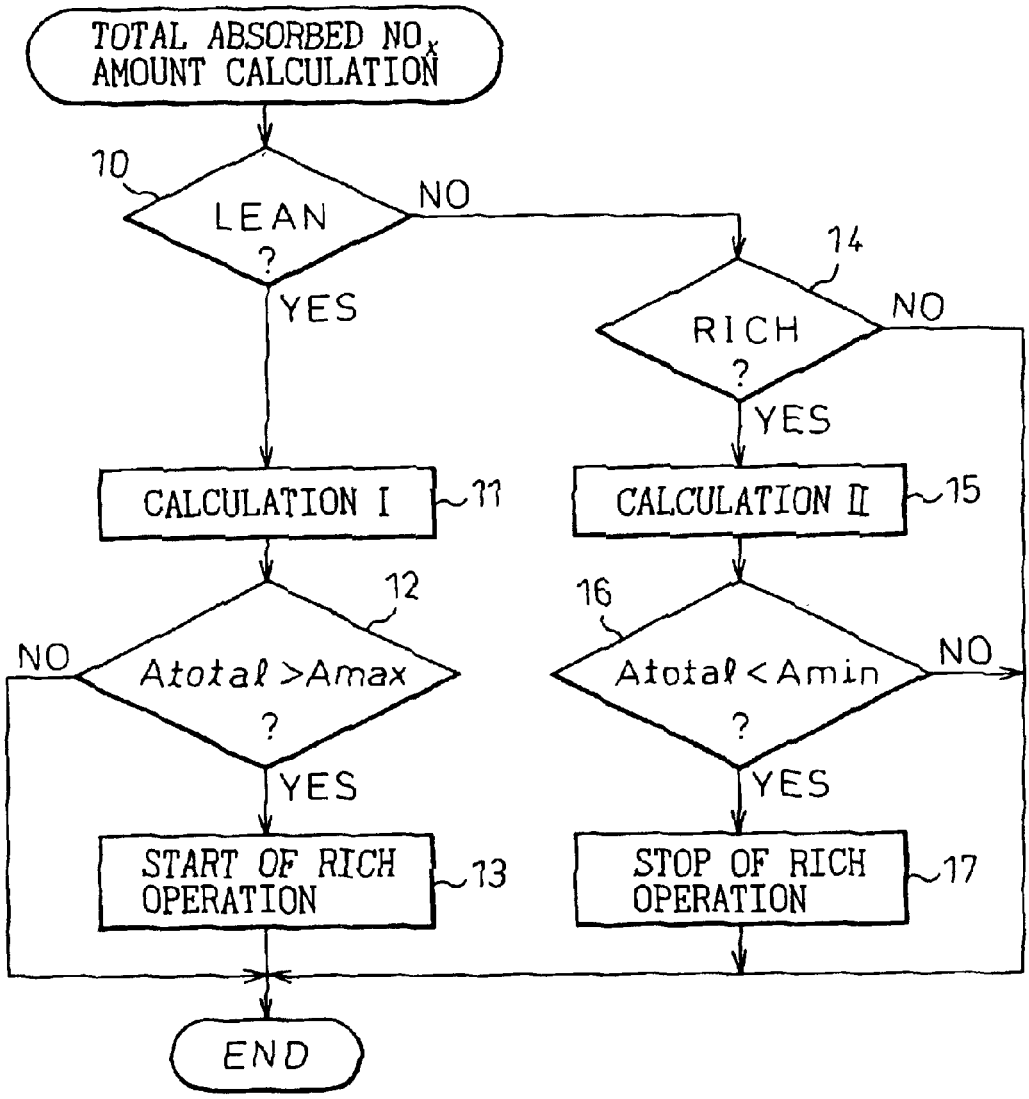
FIG. 6 is a flowchart for calculating the total absorbed NOx amount.

An example of a flowchart for calculating the total absorbed NOx amount according to the first embodiment of the invention is shown in FIG. 6. In the flowchart of FIG. 6, step 10 is for determining whether the air-fuel ratio of the exhaust gas flowing into the NOx catalyst 1 is lean or not. In the case where it is determined in step 10 that the air-fuel ratio of the exhaust gas flowing into the NOx catalyst 1 is lean, the routine proceeds to step 11 for executing the calculation process I. In the calculation process I, Vnox(k) is calculated according to equation (1) shown in FIG. 5 and, using this value Vnox(k), the total absorbed NOx amount Atotal is calculated according to equations (2) and (3) shown in FIG. 5.

In step 12, it is determined whether the total absorbed NOx amount Atotal having a value approximate to the maximum absorbable NOx amount has exceeded the tolerable critical value Amax smaller than the particular value. In the case where it is determined in step 12 that Atotal is larger than Amax, the routine proceeds to step 13 for executing the enriching process. In the enriching process, the NOx catalyst 1 is supplied with a rich gas. In the case where it is determined in step 12 that Atotal is not larger than Amax, on the other hand, the routine is terminated.

In the case where it is determined in step 10 that the air-fuel ratio of the exhaust gas flowing into the NOx catalyst 1 is not lean, on the other hand, the routine proceeds to step 14 for determining whether the air-fuel ratio of the exhaust gas flowing into the NOx catalyst 1 is rich or not. In the case where it is determined in step 14 that the air-fuel ratio of the exhaust gas flowing into the NOx catalyst 1 is rich, the routine proceeds to step 15 for executing the calculation process II. In the calculation process II, the value Vnox(k) is calculated according to equation (4) shown in FIG. 5, and using this Vnox(k), the total absorbed NOx amount Atotal is calculated according to equations (2) and (3) shown in FIG. 5.

Next, in step 16, it is determined whether the total absorbed NOx amount Atotal is smaller than the tolerable critical value and smaller than the tolerable value Amin which is substantially near to zero. In the case where it is determined in step 16 that Atotal is smaller than Amin, the routine proceeds to step 17 for stopping the enriching process. In the case where it is determined in step 16 that Atotal is larger than or equal to Amin, on the other hand, the routine is terminated. In this case, a rich gas continues to be supplied to the NOx catalyst 1.

The routine is terminated also in the case where it is determined in step 14 that the air-fuel ratio of the exhaust gas flowing into the NOx catalyst 1 is not rich.

Figure 7:
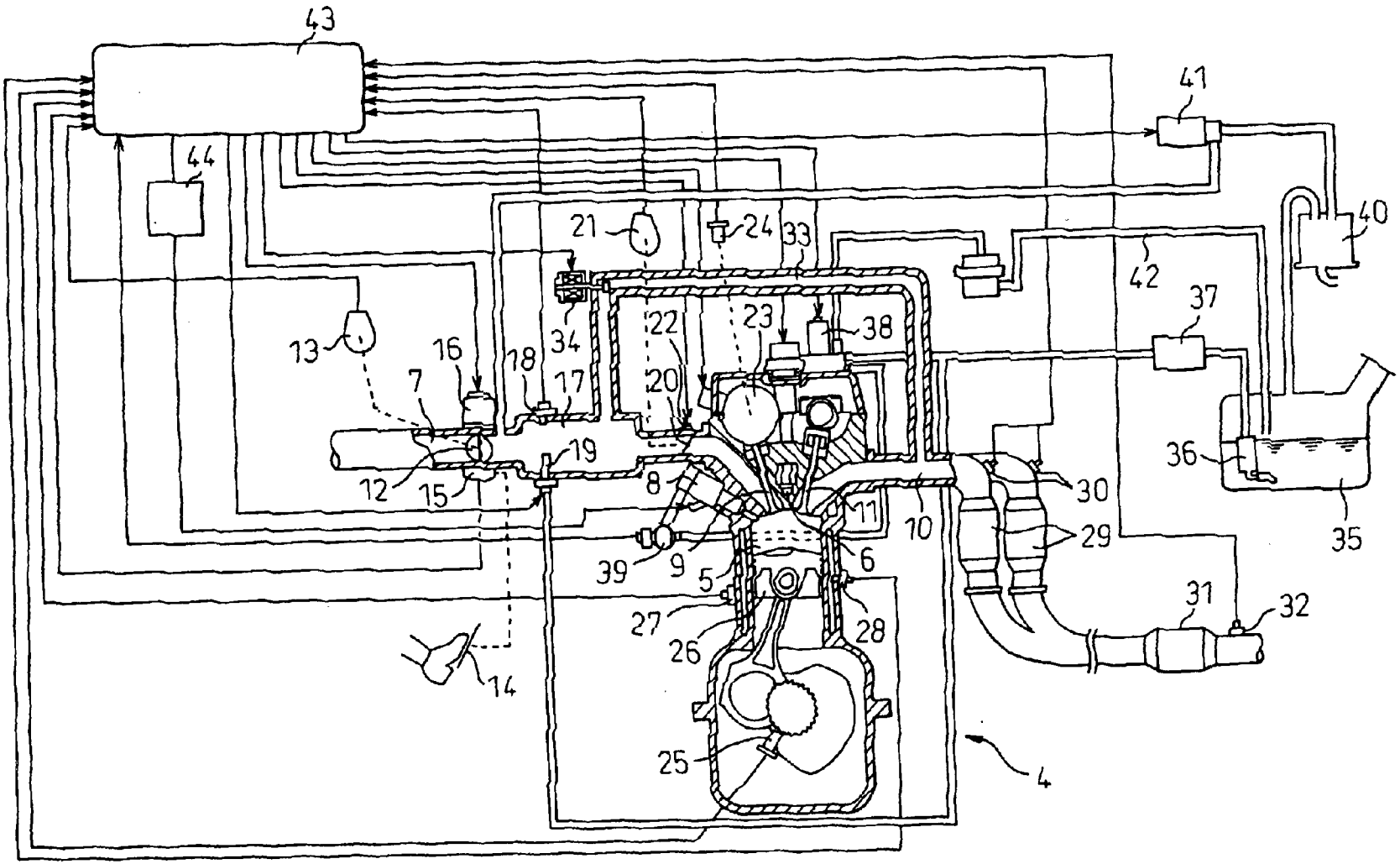
FIG. 7 is a diagram showing an internal combustion engine having an exhaust gas purification system according to a second embodiment of the invention.

Next, a second embodiment of the invention will be explained. FIG. 7 shows an internal combustion engine having an exhaust purification system according to the second embodiment. The internal combustion engine 4 is a multi-cylinder internal combustion engine, but only one cylinder is shown as a sectional view. The internal combustion engine 4 is a of such a type that fuel is injected directly in the cylinder (combustion chamber), and constitutes a lean-burn internal combustion engine. The internal combustion engine 4 generates a driving force by igniting the mixture gas in each cylinder 5 through a spark plug 6. The air introduced from an external source for combustion in the internal combustion engine 4 is passed through the intake path 7 and mixed with the fuel injected from the injector 8, thereby making up a mixture gas. An intake valve 9 is arranged between the interior of the cylinder 5 and the intake path 7. The mixture gas burnt in the cylinder 5 is discharged into the exhaust path 10 as an exhaust gas. An exhaust valve 11 is arranged between the interior of the cylinder 5 and the exhaust path 10.

A throttle valve 12 for adjusting the amount of the air introduced into the cylinder 5 is arranged in the intake path 7. This throttle valve 12 is connected with a throttle position sensor 12 for detecting the degree of opening thereof. In addition to the throttle valve 12, there are arranged an accelerator position sensor 18 for detecting the depression angle of the accelerator pedal 14 and a throttle motor 16 for driving the throttle valve 12. Though not shown in FIG. 7, an intake air temperature sensor for detecting the temperature of the intake air is mounted in the intake path 7.

A surge tank 17 is formed downstream of the throttle valve 12. A vacuum sensor 18 and a cold start injector 19 are arranged in the surge tank 17. The sensor 18 detects the pressure in the intake path 7 (intake pipe pressure). The injector 19 is for improving the cold startability of the internal combustion engine 4 and forms a homogeneous mixture gas by spraying the fuel into the surge tank 17 during the cold starting.

A swirl control valve (SCV) 20 is arranged downstream of the surge tank 17. The SCV 20 is for generating a stable swirl in the cylinder 5 at the time of lean combustion (stratified charge combustion). In addition to the SVC 20, a SVC position sensor 21 for detecting the opening degree of the SCV 20 and a DC motor 22 for driving the SVC 20 are arranged.

The operation timing of the intake valve 9 of the internal combustion engine 4 according to the second embodiment can be variably controlled by a variable valve timing mechanism 23. The open/close state of the intake valve 9 can be detected by a cam position sensor 24 for detecting the rotational position of the camshaft on the side nearer to the intake valve 9. Further, a crank position sensor 25 for detecting the rotational position of the crankshaft is mounted in the neighborhood of the crankshaft of the internal combustion engine 4. The position of the piston 26 in the cylinder 5 and the engine speed can be determined from the output of the sensor 25. The internal combustion engine 4 has mounted thereon a knock sensor 27 for detecting the knocking of the internal combustion engine 4 and a water temperature sensor 28 for detecting the cooling water temperature.

In the exhaust path 10, on the other hand, a starting catalyst (upstream exhaust gas purification catalyst) 29 constituting a normal three-way catalyst is arranged at a position nearer to the body of the internal combustion engine 4. The starting catalyst 29 is located near to the combustion chamber (cylinder) 5 of the internal combustion engine 4 and, therefore, is easily heated by the exhaust gas. At an earlier time, immediately after starting the engine, therefore, the starting catalyst 29 is increased in temperature to the catalyst activation level to purify the substances to be purified in the exhaust gas. The internal combustion engine 4 is a four-cylinder engine and has two starting catalysts 29 for each two of the cylinders. An upstream air-fuel ratio sensor 30 for detecting the air-fuel ratio of the exhaust gas flowing into each starting catalyst 29 is mounted upstream of the starting catalyst 29.

Downstream of the starting catalysts 29, the exhaust pipes are collected into a single pipe where a catalyst (NOx catalyst) 31 of NOx absorption/reduction type is arranged. The NOx catalyst 31 will be described in detail later. A downstream air-fuel ratio sensor 32 for detecting the air-fuel ratio of the exhaust gas flowing out of the NOx catalyst 31 is mounted downstream of the NOx catalyst 31. The air-fuel ratio sensors 30, 32 are each a linear air-fuel ratio sensor capable of detecting the air-fuel ratio of the exhaust gas linearly from the rich to lean zones or an $O_2$ sensor (oxygen sensor) for detecting, in on/off fashion, whether the air-fuel ratio of the exhaust gas is in the rich or lean zone.

Further, an external EGR path 33 for recirculating the exhaust gas is formed from the exhaust path 10 to the intake path 7. The portion of the external EGR path 33 nearer to the intake path 7 is connected to the surge tank 17, while the portion thereof nearer to the exhaust path 10 is connected to the exhaust path 10 upstream of the starting catalyst 29. An EGR valve 34 for adjusting the amount of the recirculated exhaust gas is arranged in the external EGR path 33. The EGR mechanism returns a part of the exhaust gas to the intake path 7 utilizing the negative internal pressure of the intake path 7 to improve both the effect of suppression of NOx generation and the fuel economy. An internal EGR control capable of producing a similar effect by controlling the on/off timing of the intake valve 9 may be used at the same time.

The fuel stored in the fuel tank 35 is sent to the injector 8 of the internal combustion engine 4 by a low-pressure fuel supply pump 36. This fuel is supplied, after being increased in pressure by a high-pressure fuel pump 38, through a fuel filter 37. The internal combustion engine 4 is capable of lean burning. In order to assure a superior lean burn (stratified charge combustion), the fuel is required to be injected directly into the cylinder 5 in compression stroke to form a state suitable for the stratified charge combustion. For this reason, the fuel is injected by the injector 8 after being increased in pressure.

In addition to the injector 8, a fuel pressure sensor 39 for detecting the fuel pressure is arranged to assure a precise control operation. The high-pressure fuel pump 38 increases the fuel pressure utilizing the motive power of the internal combustion engine 4, i.e. the rotation of the camshaft nearer to the exhaust valve 11. The cold start injector 19 is supplied with the fuel sent out from the low-pressure fuel pump 36.

In addition to the fuel tank 35, a charcoal canister 40 for capturing the fuel evaporated in the fuel tank 35 is arranged. The canister 40 includes an active carbon filter therein, whereby the evaporated fuel is captured. The fuel thus captured, while the purge amount thereof is being controlled by a purge control valve 41, is purged to the intake path 7 and combusted in the cylinder 5. The fuel tank 35 has mounted thereon a return pipe 42 for returning to the fuel tank the remaining fuel not injected.

An electronic control unit (ECU) 43 for controlling the internal combustion engine 4 in overall fashion is connected to the spark plug 6, the injector 8, the throttle position sensor 13, the accelerator position sensor 18, the throttle motor 16, the vacuum sensor 18, the cold start injector 19, the DC motor 22, the actuator of the variable valve timing mechanism 23, the cam position sensor 24, the crank position sensor 25, the knock sensor 27, the water temperature sensor 28, the air-fuel ratio sensors 30, 32, the purge control valve 41, the EGR valve 44, the intake air temperature sensor and other actuators and sensors described above.

In the system shown in FIG. 1, an electronically-controlled drive unit (EDU) 44 is disposed between the ECU 43 and the injector 8. The EDU 44 is for amplifying the drive current from the ECU 43 and driving the injector 8 with a high voltage and a larger current. These actuators and sensors are controlled based on the signal from the ECU 43 or send out the detection result to the ECU 43. The ECU 43 includes a CPU for carrying out arithmetic operations, a RAM for storing various information such as the result of arithmetic operations, a back-up RAM for holding the stored information thereof with a battery, and a ROM for storing various control programs.

Next, the oxygen absorb operation of the starting catalyst 29 will be briefly explained.

The three-way catalyst used as the starting catalyst 29 has a composition such as ceria ($CeO_2$), and has a characteristic of absorbing and discharging oxygen from the exhaust gas as well as oxidizing/reducing the component of the exhaust gas to be purified. By utilizing this oxygen absorb operation, the oxygen in the exhaust gas can be absorbed by the starting catalyst 29 and a state near to an reducing environment can be formed to promote the reduction of the extraneous NOx (nitrogen oxide) in the case where the air-fuel ratio of the exhaust gas flowing into the starting catalyst 29 is lean.

In the case where the air-fuel ratio of the exhaust gas flowing into the starting catalyst 29 is rich, on the other hand, the oxygen that has thus far been absorbed is released, so that the purification of the exhaust gas can be promoted by oxidizing the extraneous CO (carbon monoxide) and HC (hydrocarbon).

As described above, the exhaust gas purification rate can be improved by utilizing the aforementioned characteristics of absorbing and releasing oxygen. As long as the absorbed oxygen amount is accurately controlled, the exhaust gas can be purified effectively. The absorbed oxygen amount can be estimated by detecting the oxygen concentration of the exhaust gas flowing into the starting catalyst 29 using the upstream air-fuel ratio sensor 30 and calculating and accumulating the amount of oxygen absorbed/released by the starting catalyst 29 based on the detected oxygen concentration.

Using the absorbed oxygen amount and the oxygen absorption capacity thus estimated, the exhaust gas purification and hence the air-fuel ratio can be controlled to assure a suitable exhaust gas purification, thereby improving the exhaust gas purification efficiency. The reaction of the starting catalyst 29 for purification (reduction by oxidization) and the oxygen absorb/discharge reaction described above make it difficult to estimate the amount of NOx absorbed by the downstream NOx catalyst 31. By mounting another air-fuel ratio sensor immediately before the NOx catalyst 31, however, the composition of the exhaust gas flowing into the NOx catalyst can be accurately detected.

Nevertheless, the provision of another air-fuel ratio sensor in addition to the upstream air-fuel ratio sensor 30 and the downstream air-fuel ratio sensor 32 increases the cost. In view of this, the adverse effect caused by the presence of the starting catalyst 29 for controlling the NOx catalyst 31 is obviated by the exhaust gas purification system according to the second embodiment. This exhaust gas purification system will be described in detail later.

Now, let us explain the NOx catalyst 31. The NOx catalyst 31 includes a carrier with the surface thereof coated with an alumina thin film layer, which carrier carries a precious metal such as platinum, palladium or rhodium, an alkali metal (such as K, Na, Li or Cs) and an alkaline earth metal (such as Ba or Ca) or a rare earth element (La or Y), so that NOx in the exhaust gas can be absorbed while the internal combustion engine is running at a lean air-fuel ratio. Thus, the NOx catalyst 31 has the function of absorbing the NOx not reduced in the exhaust gas, in addition to the function as an ordinary three-way catalyst, i.e. the function of purifying HC, CO and NOx in the exhaust gas combusted almost at a stoichiometric air-fuel ratio.

The NOx absorbed into the NOx catalyst 31 is discharged when combusted at a rich air-fuel ratio or the stoichiometric air-fuel ratio, and thus purified by being reduced by HC and CO contained in the exhaust gas. In the process, HC and CO are purified by oxidization. In the case where it is determined that the amount of NOx absorbed into the NOx catalyst 31 has reached an almost full level, therefore, the internal combustion engine is sometimes run forcibly in what is called a rich spike mode at a rich air-fuel ratio for a short length of time to reduce the absorbed NOx.

As described above, the NOx catalyst 31 absorbs SOx (sulfur oxide) in more stable form than NOx, thereby causing SOx poisoning. Also in this case, therefore, the SOx absorbed into the NOx catalyst 31 is forcibly discharged from the NOx catalyst 31 by a rich spike operation. As a result, the capacity used by the NOx catalyst 31 for NOx absorption and reduction (absorbable NOx amount) is increased, thereby improving the purification rate of NOx contained in the exhaust gas.

Depending on the mode of operation, the rich spike operation may not be carried out. Therefore, the larger the absorbable NOx amount of the NOx catalyst 31, the better. A large amount of NOx that can be absorbed can prevent the downstream outflow of NOx that can no longer be absorbed. Especially in lean burn mode, the amount of NOx in the exhaust gas tends to increase. The NOx catalyst 31 absorbs NOx generated at the time of the lean burn operation and discharges and purifies it whenever possible at a later time, thereby improving the exhaust gas purification performance.

At the same time, if the amount of NOx absorbed into the NOx catalyst 31 can be estimated as accurately as the amount of oxygen absorbed by and the oxygen absorption capacity of the starting catalyst 29, the exhaust gas purification rate can be improved using the particular estimation. The amount of the absorbed NOx and the NOx absorption capacity are estimated basically in a manner similar to the amount of oxygen absorbed by and the oxygen absorption capacity of the starting catalyst 29. For lack of the air-fuel ratio sensor arranged immediately before the NOx catalyst 31, however, the amount of NOx absorbed and the NOx absorption capacity are estimated by accumulating the absorbed/discharged NOx amount estimated based on the characteristics of the exhaust gas flowing into the NOx catalyst 31.

At the time of calculating the absorbed/discharged NOx amount, the amount of NOx absorbed at the particular time point is also taken into account. The smaller the amount of NOx absorbed at the particular time point as compared with the NOx absorption capacity described later, for example, the easier the absorption of NOx. In the case where NOx has been absorbed to a substantially full NOx absorption capacity, on the other hand, NOx is not easily absorbed anew.

The NOx absorption capacity (or the maximum absorbed NOx amount) can be estimated from the absorbed NOx amount accumulated and updated and the output of the downstream air-fuel ratio sensor 32. Once the NOx catalyst 31 has absorbed NOx to full capacity, no more NOx can be absorbed and the extraneous NOx flows out downstream of the NOx catalyst 31. This is detected by the downstream air-fuel ratio sensor 32. In similar fashion, as long as the NOx catalyst 31 has discharged all the NOx contained therein, no more NOx is discharged even in a situation where the NOx discharge is allowed. This fact is detected by the downstream air-fuel ratio sensor 32. In this way, the upper and lower limits of the absorbed NOx amount are determined, and the difference between them is used to estimate the NOx absorption capacity.

Figure 8:
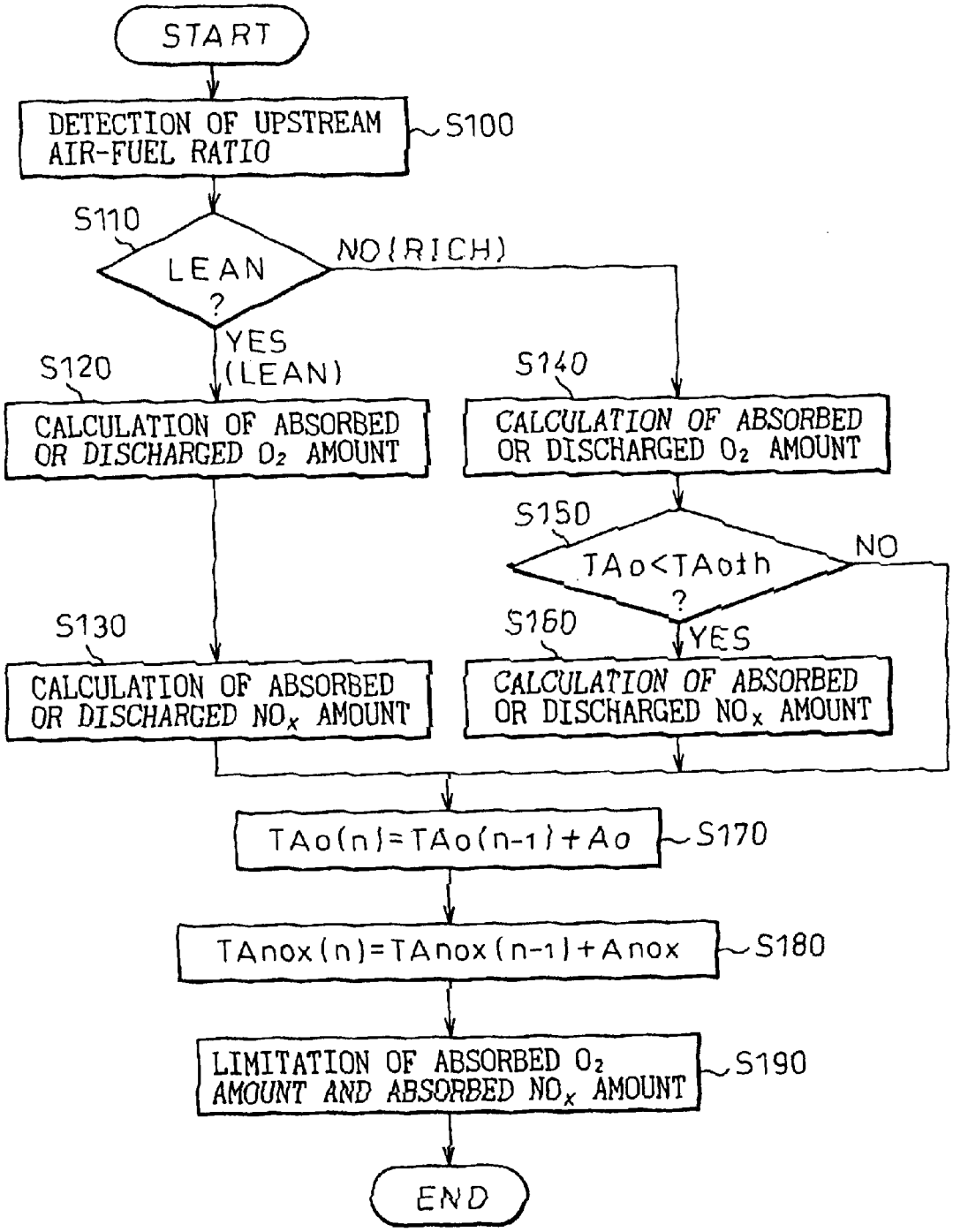
FIG. 8 is a flowchart for calculating and controlling the absorbed NOx amount according to the second embodiment of the invention.

FIG. 8 is a flowchart showing the control operation for calculating the amount of oxygen absorbed by the starting catalyst 29 and the amount of NOx absorbed by the NOx catalyst 31. First, in step 100, the air-fuel ratio of the exhaust gas flowing into the starting catalyst 29 is detected by the upstream air-fuel ratio sensor 30. In step 110, it is determined whether the detected air-fuel ratio of the exhaust gas is lean or not. In the case where the air-fuel ratio of the exhaust gas is lean, oxygen is absorbed into the starting catalyst 29 and NOx into the NOx catalyst 31. In the case where the air-fuel ratio of the exhaust gas is rich, on the other hand, oxygen is discharged from the starting catalyst 29 and NOx from the NOx catalyst 31. In the case where it is determined in step 110 that the air-fuel ratio of the exhaust gas is lean, therefore, the amount of oxygen absorbed into/discharged from the starting catalyst 29, i.e. the amount of oxygen absorbed into the starting catalyst 29 is calculated based on an oxygen absorption/discharge model in step 120.

The oxygen absorption/discharge model is defined as a mathematical model for calculating the oxygen absorption/discharge reaction in the starting catalyst 29 based on the values detected by the various sensors. According to the second embodiment, the absorbed oxygen amount is calculated by the functions of the intake amount determined from the negative pressure of the intake pipe detected by the vacuum sensor 18 and the air-fuel ratio of the exhaust gas detected by the upstream air-fuel ratio sensor 30. The amount of absorbed/discharged oxygen assumes a positive value when oxygen is absorbed and a negative value when oxygen is discharged.

In step 130 following step 120, the amount of NOx absorbed into/discharged from the NOx catalyst 31, i.e. the amount of NOx absorbed into the NOx catalyst 31 is calculated based on the NOx absorption/discharge model. The NOx absorption/discharge model is also a mathematical model used for calculating the NOx absorption/discharge reaction in the NOx catalyst 31 based on the values obtained by the various sensors and the oxygen absorption/discharge model described above. According to the second embodiment, the absorbed/discharged NOx amount is calculated as functions of the amount of fuel injected from the injector 8 and the engine speed obtained from the crank position sensor 25. The absorbed/discharged NOx amount also assumes a positive value when NOx is absorbed and a negative value when NOx is discharged.

In the case where it is determined in step 110 that the air-fuel ratio of the exhaust gas is rich or equal to the stoichiometric air-fuel ratio, on the other hand, the amount of oxygen absorbed into/discharged from the starting catalyst 29, i.e. the amount of oxygen discharged from the starting catalyst 29 is calculated in step 140. This discharged oxygen amount is obtained from the map of functions of the intake amount and the air-fuel ratio of the exhaust gas. Further, in step 150 after step 140. it is determined whether the total amount TAo of oxygen absorbed into the starting catalyst 29 at a particular time point is smaller than the oxygen amount TAoth (NOx oxygen reduction suppression amount) capable of oxidizing the reducing agent as much as is required to reduce the NOx absorbed into the NOx catalyst 31 (TAo<TAoth). In the case where the total absorbed oxygen amount TAo is not smaller than the NOx reduction suppression oxygen amount TAoth, most of the rich component of the exhaust gas is consumed for discharging the oxygen from the starting catalyst 29, and it becomes impossible to discharge NOx from the NOx catalyst 31.

In the case where the determination is affirmative in step 150, i.e. in the case where it is determined that the situation is such that the NOx absorbed into the NOx catalyst 31 is discharged, the amount of NOx absorbed into/discharged from the NOx catalyst 31, i.e. the amount of NOx discharged from the NOx catalyst 31 is calculated based on the NOx absorption/discharge model in step 160. This discharged NOx amount can also be obtained from the map of functions of the intake amount and the air-fuel ratio of the exhaust gas. In the case where the determination is negative in step 150, i.e. in the case where it is determined that the situation is such that the NOx absorbed into the NOx catalyst 31 is not discharged, on the other hand, the routine proceeds to step 170 without executing step 160.

Following step 130 or 160 or after the determination in step 150 proves negative, the absorbed oxygen amount is updated in step 170. The absorbed oxygen amount can be updated by accumulating the absorbed/discharged oxygen amount Ao on the preceding value TAo(n−1) of the total absorbed oxygen amount. In the case where oxygen is absorbed, the absorbed/discharged oxygen amount is added, while in the case where oxygen is discharged, the absorbed/discharged oxygen amount is subtracted. In step 180 after step 170, the absorbed NOx amount is updated in similar fashion. The absorbed NOx amount is also updated by accumulating the absorbed/discharged NOx amount Anox on the preceding value TAnox(n−1) of the total absorbed NOx amount. The absorbed/discharged NOx amount is added in the case where NOx is absorbed, and subtracted in the case where NOx is discharged.

Figure 9:
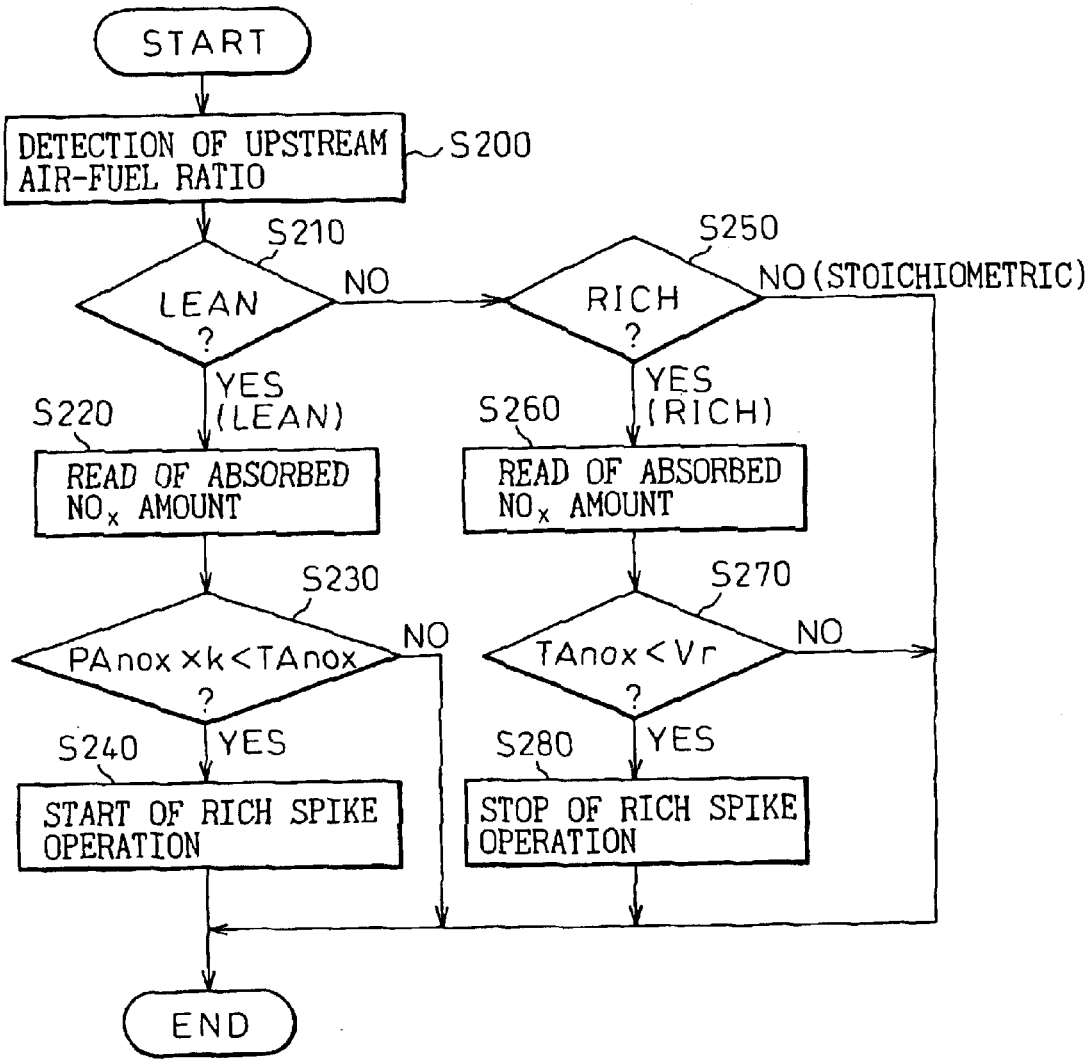
FIG. 9 is a flowchart for controlling the start of the rich spike operation according to the second embodiment of the invention.

Specifically, the total absorbed NOx amount calculated above can be obtained as an accumulated value of the amount of NOx, for example, which constitutes a specified component flowing into the NOx catalyst 31. The various sensors for producing the NOx amount and the ECU 43 for executing the arithmetic operation function as means for calculating the specific component. According to the second embodiment, the timing of executing the rich spike operation described above is determined based on the absorbed NOx amount (the accumulated value of the amount of NOx constituting the specific component) thus calculated. FIG. 9 is a flowchart for determining the timing of executing the rich spike operation. Please note that in step 190, the total oxygen and NOx amounts are limited between their upper and lower limits.

According to FIG. 9, first, in step 200, the air-fuel ratio of the exhaust gas upstream of the starting catalyst 29 is detected by the upstream air-fuel ratio sensor 30. Then, in step 210, it is determined whether the detected air-fuel ratio of the exhaust gas is lean or not. In the case where it is determined in step 210 that the air-fuel ratio of the exhaust gas is lean, the total NOx amount TAno absorbed into the NOx catalyst 31 is read in step 220. The total absorbed NOx amount TAnox thus read is equal to the absorbed NOx amount calculated by the control operation shown in the flowchart of FIG. 8. In step 230, it is determined whether the current total absorbed NOx amount TAnox is larger than the NOx absorption capacity, i.e. a predetermined proportion of the absorbable NOx amount PAnox.

This predetermined proportion is determined by a constant K. In the case where K is 0.8 and the determination in step 230 is affirmative, for example, it indicates that NOx in an amount constituting 80% of the absorbable NOx amount has already been absorbed. This constant K is determined in advance. In the case where the determination in step 230 is affirmative as described above, i.e. in the case where it can be determined that substantially the entire NOx absorption capacity of the NOx catalyst 31 has been consumed to absorb NOx, the rich spike operation is started in step 240.

Once the rich spike operation is started, NOx absorbed into the NOx catalyst 31 is discharged and reduced (purified) so that a margin of the NOx absorption capacity of the NOx catalyst 31 is secured. In the case where the determination in step 230 is negative, i.e. in the case where it can be determined that the NOx catalyst 31 still has a margin of the capacity to absorb NOx, on the other hand, the process shown in the flowchart of FIG. 3 is terminated. In this case, the rich spike operation is not started.

In the case where the determination in step 210 is negative, it is determined in step 250 whether the air-fuel ratio of the exhaust gas is rich or not. In the case where it is determined in step 250 that the air-fuel ratio of the exhaust gas is rich, the total absorbed NOx amount TAnox of the NOx catalyst 31 is read in step 260. The total absorbed NOx amount TAnox thus read is calculated by the control operation shown in the flowchart of FIG. 8. In step 270, it is determined whether the current total absorbed NOx amount TAnox is smaller than a predetermined reference value Vr (TAnox<Vr) or not.

The predetermined reference value Vr is set as a value constituting a reference for determining whether a sufficient margin of NOx absorption capacity is secured for the NOx catalyst 31 or not. In the case where the determination in step 270 is affirmative, i.e. in the case where it can be determined that the NOx catalyst 31 already has a sufficient margin of capacity to absorb NOx, the rich spike operation is terminated in step 280. In the case where the determination in step 270 is negative, i.e. in the case where a sufficient margin of the NOx absorption capacity is not yet secured for the NOx catalyst 31, the process shown in the flowchart of FIG. 3 is terminated. In this case, the rich spike operation is not terminated.

In the case where the determination in step 250 is negative, the process shown in the flowchart of FIG. 3 is terminated. In this case, the rich spike operation is neither started nor terminated. As described above, according to the second embodiment, the timing of executing the rich spike operation is determined based on the absorbed NOx amount (the accumulated value of NOx constituting a specific component). Thus, the rich spike operation can be carried out at an accurate timing based on the accumulated value of the amount of NOx flowing into the NOx catalyst 31, i.e. the amount of NOx absorbed into the NOx catalyst 31. As a result, the absorbed NOx amount is accurately estimated, and based on this accurately estimated absorbed NOx amount, the timing of executing the rich spike operation is determined. Therefore, a more effective exhaust gas purification can be accomplished by effectively utilizing the function of the NOx catalyst 31 to absorb NOx.

Further, according to the second embodiment, the degree of enriching the air-fuel ratio by the rich spike operation is determined or the enriching degree during the rich spike operation is corrected, based on the amount of the reducing component flowing into the NOx catalyst 31. The reducing component is a component for reducing NOx absorbed into the NOx catalyst 31 during the rich spike operation, or specifically HC or CO. The enriching degree is defined as the degree of richness, i.e. whether the air-fuel ratio is near to the stoichiometric air-fuel ratio or very rich.

Specifically, in the case where the amount of the reducing component of the exhaust gas flowing into the NOx catalyst 31 is small, neither the NOx absorbed into the NOx catalyst 31 can be discharged nor the SOx poisoning of the NOx catalyst 31 can be obviated by the rich spike operation. In such a case, therefore, the enriching degree is to a higher level or corrected in order to secure the effect of the rich spike operation for the NOx catalyst 31.

Conversely, in the case where the amount of the reducing component of the exhaust gas flowing into the NOx catalyst 31 is large, an extraneous reducing component is liable to flow downstream out of the NOx catalyst 31, although the effect of the rich spike operation is fully exhibited for the NOx catalyst 31. In such a case, therefore, the enriching degree is set to a value near to the stoichiometric air-fuel ratio (fairly rich) or corrected so that the effect of the rich spike operation may be exhibited properly for the NOx catalyst 31.

As a method other than controlling the air-fuel ratio during the fuel combustion, the enriching degree can be controlled by fuel injection in the exhaust stroke. In this way, the fuel combustion during exhaust stroke can increase the reducing component (especially, HC) of the exhaust gas and thus increase the enriching degree. Instead of determining the enriching degree based on the reducing component of the exhaust gas as in this invention, the rich profile, such as the length of the rich spike operation, can be changed to attain the same purpose.

As another alternative, the rich profile is changed in accordance with the absorbed oxygen amount of the starting catalyst 29 or in accordance with the temperature of the starting catalyst 29. As still another alternative, the rich profile is changed in accordance with the degree of degeneration of the starting catalyst 29. This is by reason of the fact that the effect of the rich spike operation on the NOx catalyst 31 located downstream is varied with the conditions of the starting catalyst 29. Thus, the NOx absorbed into the NOx catalyst 31 is efficiently reduced while suppressing the deterioration of fuel economy. As a result, the function of the NOx catalyst 31 to absorb NOx is utilized efficiently for an improved exhaust gas purification performance.

The first and second embodiments may be combined with each other. According to a third embodiment including a combination of the first and second embodiments, the amount of NOx absorbed into each area of the NOx catalyst 31 is calculated in the way specified in the first embodiment, and then these absorbed NOx amounts are totalized to calculate the total NOx amount absorbed into the NOx catalyst 31. Specifically, the model of the first embodiment is employed as a NOx absorption/discharge model of the second embodiment. According to the third embodiment, the timing of executing the rich spike operation is determined based on the total absorbed NOx amount thus calculated.

Also, according to the third embodiment, when the exhaust gas of a rich air-fuel ratio is flowing into the NOx catalyst 31, or when the rich spike operation is being performed, for example, the amount of NOx discharged from the NOx catalyst 31 is calculated based on the amount of the reducing agent flowing into the NOx catalyst 31. This discharged NOx amount is subtracted from the total absorbed NOx amount to thereby obtain the total absorbed NOx amount.

Further, according to the third embodiment, as long as the rich spike operation is being performed, the amount of the reducing agent flowing into the NOx catalyst, i.e. the increment of the amount of the fuel injected from the injector 8 is controlled in such a manner that the desired amount of the reducing agent flows into the NOx catalyst based on the amount of the reducing agent flowing into the NOx catalyst.

What is claimed is:

1. An exhaust gas purification system comprising:

a NOx catalyst for absorbing NOx in exhaust gas when the air-fuel ratio of inflowing exhaust gas is lean and purifying by reducing absorbed NOx with a reducing agent in the exhaust gas when the air-fuel ratio of the exhaust gas turns rich;

calculation means for calculating the amount of NOx absorbed per unit time in each area of a plurality of areas of the NOx catalyst when the air-fuel ratio of the exhaust gas flowing into the NOx catalyst is lean; and means for calculating the total amount of NOx absorbed into the NOx catalyst by totalizing the amounts of NOx calculated by said calculation means for the plurality of areas of the NOx catalyst.

2. An exhaust gas purification system according to claim 1, further comprising means for supplying the exhaust gas of a rich air-fuel ratio to the NOx catalyst when the NOx amount reaches a tolerable critical value.

3. An exhaust gas purification system, comprising:

a NOx catalyst arranged in the exhaust path;

an exhaust gas purification catalyst arranged in the exhaust path upstream of said NOx catalyst;

calculation means for calculating a value associated with the amount of at least one component flowing out from said exhaust gas purification catalyst into said NOx catalyst; and rich spike execution means for executing a rich spike operation based on a value associated with the amount of the component calculated by said calculation means, wherein said component includes NOx absorbed into said NOx catalyst when a rich spike operation is not executed and a reducing component for reducing the NOx absorbed into said NOx catalyst when the rich spike operation is executed, and said value associated with the amount of said component calculated by said calculation means is a value obtained by accumulating the amounts of NOx flowing into said NOx catalyst when the rich spike operation is not executed and by subtracting said value associated with the amount of said reducing component flowing into said NOx catalyst when the rich spike operation is executed.

4. An exhaust gas purification system according to claim 3, wherein said component is NOx and said value associated with the amount of the component calculated by said calculation means is an accumulated value of the amounts of NOx flowing into said NOx catalyst.

5. An exhaust gas purification system according to claim 4, wherein the amount of the reducing agent flowing into said NOx catalyst is controlled based on the amount of said reducing component flowing into said NOx catalyst when the rich spike operation is executed.

6. An exhaust gas purification system according to claim 3, wherein said component is NOx, and the NOx catalyst absorbs the NOx in the exhaust gas when the air-fuel ratio of the exhaust gas flowing into said NOx catalyst is lean while the NOx catalyst purifies the absorbed NOx by being reduced with the reducing component in the exhaust gas when the air-fuel ratio of the influent exhaust gas turns rich.

7. An exhaust gas purification system comprising:

a NOx catalyst arranged in the exhaust path;

an exhaust gas purification catalyst arranged in the exhaust path upstream of said NOx catalyst;

first calculation means for calculating the amount of the component flowing out from said exhaust gas purification catalyst and absorbed into each area of a plurality of areas of said NOx catalyst per unit time;

second calculation means for calculating the total amount of said component absorbed into said NOx catalyst by totaling the amounts of said component for the plurality of areas of said NOx catalyst each calculated by said first calculation means; and rich spike execution means for executing the rich spike operation based on the amount of said component calculated by said second calculation means.

8. An exhaust gas purification system according to claim 7, wherein said component is NOx and the NOx catalyst absorbs the NOx in the exhaust gas when the air-fuel ratio of the influent exhaust gas is lean while the NOx catalyst purifies the absorbed NOx by being reduced with a reducing agent in the exhaust gas when the air-fuel ratio of the influent exhaust gas turns rich.

9. An exhaust gas purification system according to claim 7, wherein said component is NOx and the total component amount calculated by said second calculation means is an accumulated value of the amounts of NOx absorbed into said NOx catalyst.

10. An exhaust gas purification system according to claim 7, wherein said component includes NOx absorbed into said NOx catalyst when the rich spike operation is not executed and the reducing component for reducing the NOx absorbed into said NOx catalyst when the rich spike operation is executed and the total component amount calculated by said second calculation means is a value obtained by accumulating the amounts of NOx absorbed into said NOx catalyst when the rich spike operation is not executed and by subtracting a value associated with the amount of the reducing component flowing into said NOx catalyst when the rich spike operation is executed.

11. An exhaust gas purification system according to claim 10, wherein the amount of the reducing agent flowing into said NOx catalyst is controlled based on the amount of the reducing component flowing into said NOx catalyst when the rich spike operation is executed.

* * * * *